US007195066B2

(12) United States Patent
Sukup et al.

(10) Patent No.: US 7,195,066 B2
(45) Date of Patent: Mar. 27, 2007

(54) ENGINEERED SOLUTION FOR CONTROLLED BUOYANCY PERFORATING

(76) Inventors: Richard A. Sukup, 6300 Ridglea Pl., Fort Worth, TX (US) 76116; William T. Bell, 2534B FM 1375E, Huntsville, TX (US) 77374

( * ) Notice: Subject to any disclaimer, the term of this patent is extended or adjusted under 35 U.S.C. 154(b) by 279 days.

(21) Appl. No.: 10/696,697

(22) Filed: Oct. 29, 2003

(65) Prior Publication Data

US 2005/0092493 A1 May 5, 2005

(51) Int. Cl.
*E21B 43/116* (2006.01)

(52) U.S. Cl. ..... 166/298; 166/55.2; 175/4.6

(58) Field of Classification Search ..... None
See application file for complete search history.

(56) References Cited

U.S. PATENT DOCUMENTS 4,509,604 A 4/1985 Upchurch
4,744,424 A 5/1988 Lendermon et al.
5,564,499 A 10/1996 Willis et al.
5,859,383 A * 1/1999 Davison et al. ..... 102/307
6,520,258 B1 * 2/2003 Yang et al. ..... 166/297
6,554,081 B1 * 4/2003 Brooks et al. ..... 175/4.54
6,732,798 B2 * 5/2004 Johnson et al. ..... 166/297
6,865,978 B2 * 3/2005 Kash ..... 89/1.15
2002/0189482 A1 * 12/2002 Kneisl et al. ..... 102/306
2003/0037692 A1 * 2/2003 Liu ..... 102/301

* cited by examiner

*Primary Examiner*—Zakiya W. Bates
(74) *Attorney, Agent, or Firm*—W. Allen Marcontell

(57) ABSTRACT

The weight of a shaped charge carrier is predetermined as a buoyancy control parameter for perforating guns. Each charge carrier comprises a co-axial assembly of inner and outer carrier units. Both carrier units may be fabricated from low density metals or composite materials comprising high strength fibers in a polymer matrix. The outer carrier wall thickness may be a weight control parameter. Shaped charge units having no independent casement are formed into sockets within a light-weight inner carrier unit. Alternatively, the shaped charge units may be formed within light-weight material cases and seated within sockets in the light-weight inner carrier unit. Materials and dimensions are selected to substantially achieve the desired carrier buoyancy in the specific well fluid whereby a perforating gun assembled from a plurality of the carriers may be substantially floated into a completion position and allowed to settle along the floor or ceiling of the wellbore as predetermined by the perforation direction.

36 Claims, 2 Drawing Sheets

ENGINEERED SOLUTION FOR CONTROLLED BUOYANCY PERFORATING

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention generally relates to downhole well tools and specifically to shaped charge perforating guns for subterranean wells.

2. Description of Related Art

Traditional petroleum drilling and production technology often includes procedures for perforating the wall of a production well bore to enhance a flow of formation fluid along perforation channels into the fluid bearing strata. Depending on the well completion equipment and method, it is necessary for such perforations to pierce the casing, production pipe or tube wall. In many cases, the casing or tube is secured to the formation structure by a cement sheath. In these cases, the cement sheath must be pierced by the perforation channel as well.

There are three basic methods presently available to the industry for perforating wells. Those three methods are: a) explosive propelled projectiles, b) pressurized chemicals and c) shaped charge explosives. Generally, however, most wells are perforated with shaped charge explosives.

Shaped charge explosives are typically prepared for well perforation by securing a multiplicity of shaped charge units within the wall of a heavy wall, steel pipe joint. The pipe joint bearing the shaped charges may be supported at the end of a wireline, coiled tube, coupled pipe or drill string for location within the wellbore adjacent to the formation zone to be perforated by detonation of the shaped charges.

Collectively, a pipe joint and the associated charge units will be characterized herein as a "charge carrier." One or more operatively coupled charge carriers providing a single operating unit of extended length shall be characterized herein as a "perforating gun." A perforation gun is merely one of many "bottom-hole assemblies" or bottom-hole tools the present invention is relevant to.

Each shaped charge unit in a charge carrier comprises a relatively small quantity of high energy explosive. Traditionally, this charge unit is formed about an axis of revolution within a heavy steel case. One axial end of the shaped charge unit is concavely configured. The concave end-face of the charge is usually clad with a thin metallic liner. When detonated, the explosive energy of the decomposing charge is focused upon the metallic liner. The resulting pressure on the liner compressively transforms it into a high speed jet stream of liner material that ejects from the case substantially along the charge axis of revolution. This jet stream penetrates the well casing, the cement sheath and into the production formation.

A multiplicity of charge units is usually distributed along the length of each charge carrier. Typically, the shaped charge units are oriented within the charge carrier to discharge along an axis that is radial of the carrier longitudinal axis. The distribution pattern of shaped charge units along the charge carrier length for a vertical well completion is typically helical. However, horizontal well completions may require a narrowly oriented perforation plane wherein all shaped charge units in a carrier discharge in substantially the same direction such as straight up, straight down or along some specific lateral plane in between. In these cases, selected sections of charge carriers that collectively comprise a perforation gun may be joined by swivel joints that permit individual rotation of a respective section about the longitudinal axis. Additionally, each charge carrier is asymmetrically weighted to gravity bias the predetermined rotational alignment when the gun system is horizontally positioned.

In situ petroleum, including gas and oil (crude oil), is often found as a gaseous or viscous fluid that substantially saturates the interstices of a porous geologic strata. In some cases the petroleum bearing strata is distributed over an expansive area having a relatively small thickness. For example, a porous strata saturated with crude oil may extend for miles in several directions at a nominal depth of about 6500 ft. but with only a 10 to 20 ft. thickness. A normal or vertical penetration of the strata to extract the crude could only have about 10 ft. of perforated production face. Notwithstanding an abundant total of petroleum reserves present in the strata (formation), the production rate through one well would be relatively small. To efficiently drain the formation, numerous such wells would be required. The enormous cost of each well is well known to the industry.

In cases as described above, the producer may elect to amplify the fluid production from a single well by increasing the length of the well production face within the fluid bearing formation. Generally, such production face increases are achieved by guiding the well borehole direction along a plane located at or near the bottom of the formation and substantially parallel with the lay of the formation. Such a completion strategy has been characterized in the art as Extended Reach Drilling (ERD). Using ERD, the producer may penetrate the formation with a production face length of 6,000 ft., for example. Typically, however, 6,000 ft. of substantially horizontal, perforated well production face along a geologic formation that is 6,500 ft. beneath the earth's surface may require a total, deviated borehole length that is as much as 35,000 ft. (7 miles).

Following prior art technologies, a mile of horizontal well bore is usually perforated in increments: each requiring a separate round trip. There are several factors contributing to such relatively short perforation length increments in ERD completions. Most factors, however, relate to the length and, hence, weight, of perforating gun structure that may be positioned in the wellbore adjacent to the fluid production zone. One such factor, for example, is the structural or mechanical strength capacity of the support string (wireline, tubing, drill string or derrick) to support the suspended weight of a full length perforating gun that is constructed predominately of steel. In the case of the above example, a full length gun may be 5,000 to 6,000 feet long. At a representative weight distribution rate of 14.75 #/ft. for example, such a gun would weigh 75,000 to 90,000 lbs.

Another factor that limits the length of a traditional perforating gun that is assembled with a plurality of heavy steel charge carriers according to prior art practice, is the magnitude of axially imposed "push" force along the perforation gun axis necessary to overcome the friction force bearing on the perforating gun surface as it is pressed by gravity against the bottom elements of the wellbore wall.

That portion of a wireline, drill string or coiled tubing suspended vertically below the drilling platform is supported entirely by the casing head or by the derrick structure. As the course of the wellbore direction departs from vertical and becomes increasingly horizontal, the wellbore direction enters an angular zone of repose. The "angle of repose", usually measured relative to the horizontal plane, is that angle from horizontal at which static frictional forces acting on a structure at the supporting surface interface are greater than the gravity forces (potential energy) on the same structure. In brief restatement, the angle of repose is the maximum surface slope that will statically sustain the position of a structure on the surface. If the surface slope angle is increased above the angle of repose, static friction force on the structure is exceeded by gravitational force and the structure begins to slide downwardly along the surface. The term "angle of repose" and associated concept is to be distinguished from the term and concept associated with "deviation angle" which is a wellbore direction angle measured from vertical.

Coiled tubing, coupled tubing or pipe, and drill pipe are bottom-hole assembly support strings that have some compressive force transfer capacity. Wirelines have little or no capacity to transmit compressive force but nevertheless support considerable weight in the tensile mode. The mass of a tubing or pipe support string in a borehole above the angle of repose transfers a pushing force to that portion of a support string below the angle of repose. At some point, however, the frictional force on the support string below the angle of repose exceeds the compressive force from the support string above the angle of repose. Typically, the coefficient of friction between a pipe or coiled tubing string and a wellbore wall may be about 0.50 lb drag/lb normal wt. At that point of force equilibrium, natural forces will position the bottom-hole assembly no deeper along the wellbore. To increase borehole penetration of the bottom-hole assembly, external force must be applied.

Responsive to a need for external force to push a bottom-hole assembly further along a horizontal borehole, the prior art has engaged a mobility tool often characterized as a "tractor." The tractor is a mechanical device driven by a hydraulic circulation stream within a pipe or tubing suspension string or by an electric motor served by a wireline supported electrical conduit. The device is positioned in the support string above the bottom-hole tool assembly/perforating gun. Driving surfaces on the tractor, such as wheels having a serrated perimeter or circulating tracks with lugs, engage the borehole wall and "push" the heavy steel perforating gun along the wellbore wall. At the present state of development, tractors may be capable of 4,500 to 5,000 lbs. thrust.

A typical 5 in. perforating gun assembled from heavy steel charge carriers may have an air environment weight of about 14.75 #/ft. Nominally, steel has a specific gravity of about 7.83. When immersed in water having a density of about 62 #/ft$^3$ as is often found in a downhole environment, the weight distribution of the perforating gun is reduced by about 8.45 #/ft. Buoyancy of a structure is a function of the volume of fluid displaced by the structure and the weight of that displaced volume.

For an atypical example, assume a 5 in. perforating gun having a 0.1363 ft$^3$/ft. volumetric displacement envelope. The gun has an air weight distribution of about 14.75 #/ft. and a downhole weight distribution in water of about 6.30 #/ft. This gun is to be pushed by a tractor along a 6000 ft. horizontal completion bore that imposes a coefficient of friction of 0.5 # drag/# normal weight along the gun length. The tractor in the suspension string is assumed to have a maximum thrust of about 4,500 lb. A generalized approximation of the maximum gun length that may be positioned in the horizontal wellbore may be determined as follows:

[0.5 lb drag/lb nor.wt.(coeff. of friction)]×6.30 # wt./ft. gun=3.15 # drag/ft. gun

[4,500 lb thrust(tractor)]/3.15 # drag/ft. gun=1429 ft. gun

Accordingly, the perforation operation is limited to a maximum gun length of 1429 ft. Therefore, 4 to 5 round trips into the well are required to shoot the full length of the 6,000 ft. perforation zone. However, only the first shot may be under underbalanced pressure conditions. More will be subsequently explained about underbalanced pressure conditions.

Proposals have been made to supplement the tractor technology with strategically placed carriage wheels along the perforating gun to reduce the coefficient of friction element of the equation. If effective as proposed, distributed carriage wheels may decrease the overall coefficient of friction by half or more. Consequently, only 2 to 3 round trips to complete the well perforation of 6000 ft. would be required. At the same time, however, the addition of wheels to the gun structure reduces the useful gun diameter and increases the gun weight. Furthermore, several shaped charges and respective production perforations may be sacrificed for each carriage wheel on the gun. Most damaging, however, is the loss of useful gun diameter which has the consequence of reducing the maximum size of shaped charge unit that may be used in the gun and hence, the size and depth of perforation.

Although tractor technology provides means to increase the length of a horizontal perforating gun, such means remain insufficient to position a single, 6000 ft. perforating gun of unified length in a substantially horizontal wellbore. Such completions are still burdened by the need for incremental perforation procedures and multiple "round trips" into the well.

There is a standing desire of all deep well producers to complete the well in as few trips as possible: preferably only one. Rig time on a well location is measured in thousands of dollars per hour. The rig time required for a 35,000 foot round trip may be several, 24 hour days. This is not borehole advancement time (drilling) but merely the task of withdrawing a bottom-hole tool or assembly, whether drill bit or perforating gun, and returning with another. Obviously, 4 or 5 round trips into and out of a 35,000 foot well is enormously expensive.

The expense of multiple trips to complete a horizontal production bore is not the only penalty of a multiple trip completion. Petroleum bearing earth strata are not often of uniform porosity and/or permeability. A flow conducive pressure differential of greater in situ pressure in the formation than in the wellbore is characterized as an underbalance. Degrees of minimum underbalance necessary to extract full flow from a particular area of production zone may be highly variable along the borehole length. Also highly variable is the minimum underbalance necessary to flush the perforation channel of perforation debris. To clean up the perforations and start the flow of formation fluid into the wellbore along the perforation channels in one area of a formation may require an underbalance of only 500 psi pressure differential between the formation pressure and the wellbore pressure. Along another area of the same formation, a 2,000 psi differential of underbalance may be required to initiate flow and clean up the perforations.

The well producer is afforded only one opportunity to perforate an underbalanced well at the pressure differential required by the formation circumstances. At the time of that one opportunity, the well pressure may be drawn down to or near the greatest pressure differential required to induce flow from the most reticent flow area. Following the first gun shot, it is no longer possible to reduce the internal wellbore pressure significantly below the in situ formation pressure. Consequently, any subsequent shot increments necessary to complete a multiple gun perforation must be made at a substantially balanced well pressure. Accordingly, many of the flow reticent perforation channels may not be flushed of perforation debris and therefore fail to produce the fluid flow rate that may otherwise be expected.

Both long and short length horizontal completions may be plagued by a reduction of shaped charge penetration capacity. Predominately, a horizontal wellbore is perforated upwardly to induce a gravity expulsion of debris from the perforation channels. However, prior art perforating guns generally rest against the floor of the horizontal wellbore when the shot is taken. Due to the fact that the wellbore diameter is significantly greater than the perforating gun diameter, the shaped charge perforation jets must leap the asymmetry gap before effective perforation begins. Traversal of the asymmetry gap consumes and diverts a significant portion of the jet energy thereby reducing the penetration capacity. In a perfect world, the uppermost surface element of the perforation gun would be positioned in contact juxtaposition with the uppermost surface elements of the wellbore at the moment of an upwardly directed shaped charge ignition.

BRIEF SUMMARY OF THE INVENTION

An important object of the present invention, therefore, is to greatly reduce the weight of a perforating gun. Another important object of the invention is a method to control the buoyancy of a downhole tool to within about ±0.5 to about ±0.25 #/ft. An important corollary to these objectives is a method for controlling the buoyancy of a perforating gun. A similar objective of the invention is to substantially reduce or eliminate frictional resistance to horizontal placement of perforating guns. Also an objective of the present invention is a procedure for floating a perforating gun into a substantially horizontal bore hole position. A further object of the invention is a means and procedure for perforating a long, horizontal and underbalanced wellbore with a single perforating gun positioned by a single round trip.

Other objects of the invention may include a procedure for reducing or eliminating the need for tractors and carriage wheels to position a long perforating gun of maximum diameter for the well circumstance. Another object of the invention is a substantial reduction in the density of a shaped charge carrier, shaped charge cases and of a perforating gun assembled from these components. Also an invention object is substantial weight reduction in individual shaped charge cases. A still further object of the present invention is a perforating gun assembly that may be substantially supported buoyantly by wellbore fluids to reduce frictional forces acting on the assembly. Another object of the invention is a method and apparatus for placing horizontal perforating guns of extended length while substantially supported by well fluid buoyancy forces. It is also an object of the present invention to substantially increase the effective length of perforating guns. A methodical approach to determining and adjusting the buoyancy of a perforating gun to compliment the perforation objectives is also an object of the invention.

The present invention addresses the above objectives, and others to emerge from the detailed description to follow, with a synergistic combination of material and construction differences from prior art practice. Among such differences are a realignment of design priorities. Unlike most bottom-hole assemblies that are designed to function for long periods under hostile conditions, a perforating gun is required to function only once. And that single moment of function occurs within a few hours or at most, several weeks, of first entering the wellbore. Hence, long use-life and environmental durability are not essential characteristics of a perforating gun.

One of the minimally essential properties of a perforating gun is the compressive hoop strength of a charge carrier external wall to withstand the crushing, hydrostatic bottom-hole pressure. The charges and respective fuse or ignition mechanism must be protected from well fluid invasion prior to detonation. Reduced to essence, the gun designer is advised to determine the minimum wall thickness required for a charge carrier to successfully oppose the expected operational pressure. This minimal thickness is also a function of the fabrication material which may be, for example, steel, aluminum, bronze, or plastic composite.

Another essential perforating gun property is the tensile hoop strength of the carrier wall. When the shaped charge explosives ignite, a large pressure surge is exerted internally of the carrier wall. If this pressure surge expands the carrier wall excessively, removal of the spent gun from the wellbore may be prevented.

It is also essential to consider the longitudinal tensile strength of the charge carriers for capacity to support the length of gun suspended below each charge carrier section. This design criterion includes a pre and post detonation dynamic due to change in the gun buoyancy after discharge.

Another guiding property of a perforating gun is that of generally loading the charge carriers with the largest shaped charge that may be accommodated by the wellbore diameter. For example, an open-hole completion of an 8 in. OD horizontal wellbore at a depth of 6,500 ft. may be treated by a 5 in. OD perforating gun. For purposes of the present example, assume that a 5 in. OD is the largest diameter structure that may pass through well control elements in the wellbore above the production zone.

When internally sealed, the 0.1363 $ft^3$/ft distributed volume of the 5 in. OD gun diameter displaces a corresponding volume of well fluid. The 8.45 #/ft of 62 #/$ft^3$ wellbore fluid displaced by that 0.1363 $ft^3$/ft distributed volume of the gun becomes the distributed buoyant force on the gun in direct opposition to the distributed gun weight. When the buoyant force is greater than the gun weight, the gun floats. When the buoyant force is less than the gun weight, the gun sinks.

With respect to the present invention, the distributed weight of a charge carrier structure that is minimally essential (1) to protect the gun charges from wellbore fluid invasion, (2) to resist excessive radial expansion when the charges are detonated and (3) to retain sufficient tensile strength for removal from the wellbore after discharge is balanced against the distributed buoyancy of the gun volume. For most perforating gun designs using traditional fabrication materials, the distributed gun weight is large compared to the corresponding buoyancy.

Pursuant to the present invention, the distributed weight of the gun charge carriers for long perforating guns may be designed within the above envelope to give the gun the desired bottom-hole buoyancy, whether positive, negative or neutral. In any case, a perforating gun or other bottom-hole assembly that is of great length may be assembled and positioned in a substantially horizontal wellbore with little or no regard to a pushing force. Once positioned, a fractional buoyant imbalance in assembly will settle the assembly against the top or bottom of the wellbore depending on the predetermined buoyancy. But because the normal force of the bottom-hole assembly against the wellbore wall is so slight, the frictional opposition to longitudinal movement of the suspension string is substantially none.

Additional objects and advantages of the invention will become apparent to those skilled in the art upon reference to the detailed description when taken in conjunction with the illustrations hereafter.

BRIEF DESCRIPTION OF THE SEVERAL VIEWS OF THE DRAWINGS

The invention is hereafter described in detail and with reference to the drawings wherein like reference characters designate like or similar elements throughout the several figures and views that collectively comprise the drawings. Respective to each drawing figure.

DETAILED DESCRIPTION OF THE INVENTION

Figure 1:
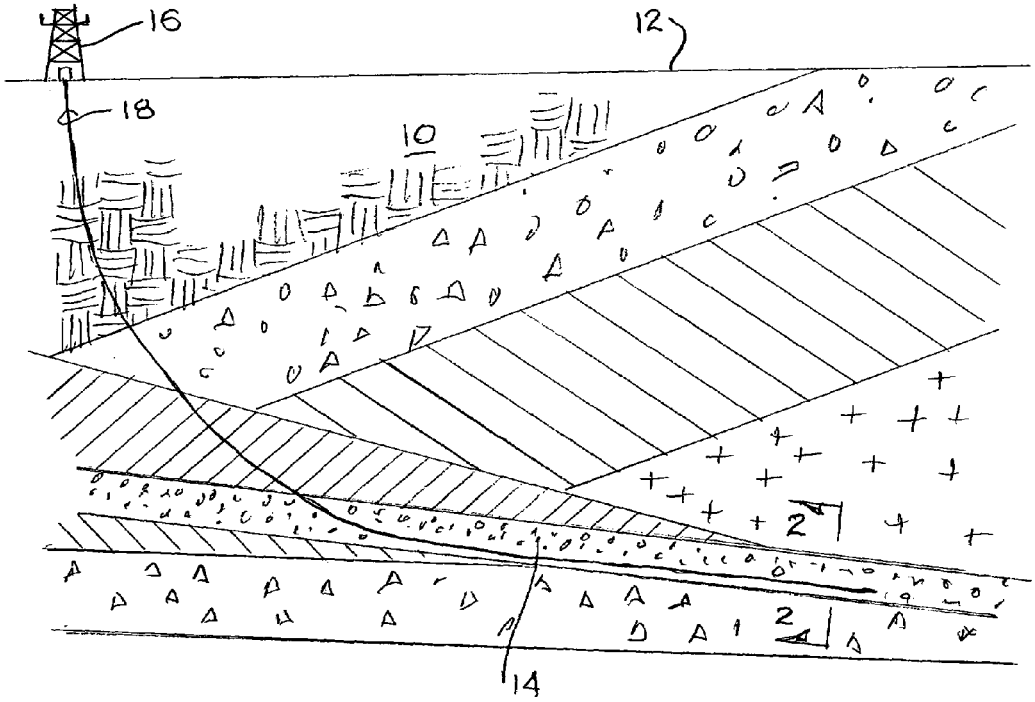
FIG. 1 is a schematic earth section illustrating a deviated wellbore having a substantially horizontal fluid bearing strata.

For environmental reference, FIG. 1 represents a cross-section of the earth 10. Below the earth surface 12, the earth firmament comprises a number of differentially structured layers or strata. A thin and mildly sloped strata 14 is of particular interest due to an abundant presence of petroleum.

From a drilling/production platform 16 on the earth surface 12, an extended wellbore 18 is drilled into and along the strata 14. In this case, the wellbore 18 is drilled to follow the bottom plane of the strata.

There are many well completion systems. Although the present invention is relevant to all completion systems in one form or another, the "cased hole" completion represented by FIG. 2 serves as a suitable platform for describing a presently preferred embodiment of the invention.

Figure 2:
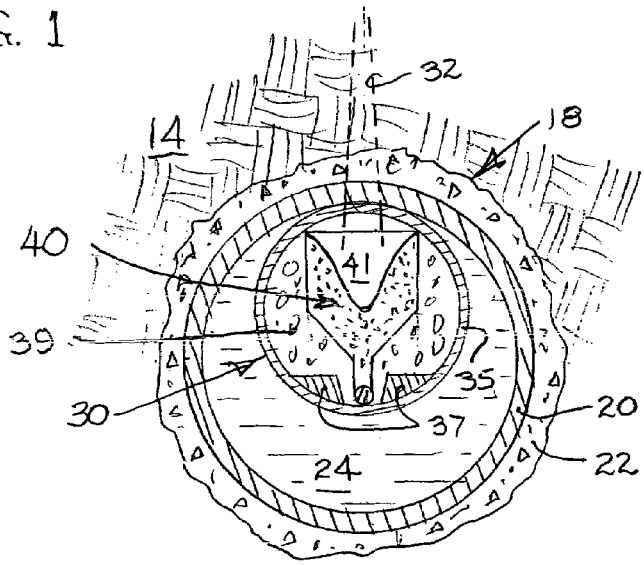
FIG. 2 is a is a wellbore cross-section as seen from the FIG. 1 cutting plane 2—2 illustrating the present invention perforating gun buoyed against the upper wall elements of the wellbore wall.

With respect to FIG. 2, traverse of the production strata 14 by the borehole 18 is lined by casing 20 set within a cement sheath 22. In the course of drilling and/or casing, the borehole 18 and ultimately, the casing 20, is flooded with fluid. Usually, the fluid is liquid and usually includes water. In some wells, the fluid is natural gas. The present example of a preferred invention embodiment proceeds with a liquid environment 24 within the well casing 20.

After the wellbore 18 is cased, the casing 20 and cement sheath 22 must be perforated to allow fluid production flow from the strata 14 into the casing interior and ultimately, into a production tube not shown. Typically, the casing, cement sheath and formation are perforated by the shaped charge jet as represented by the converging dashed lines 32 of FIG. 2. The mechanism of such perforations may be a perforation gun 30 according to the present description.

Typically, the perforating gun is an assembly of several charge carriers. Two or more charge carrier units may be linked by swivel joints for relative rotation about a longitudinal tube axis to facilitate gravity orientation.

Those of skill in the art are knowledgeable of several techniques for orienting a horizontally positioned downhole tool with respect to a vertical plane. As a non-illustrated example, the outer perimeter of a charge carrier wall may be fabricated eccentrically of the inner bore perimeter thereby creating a weighted moment of wall mass concentration eccentrically concentrated about the charge carrier axis. If allowed to rotate about the charge carrier axis, the line of eccentrically concentrated wall mass will seek a bottom-most position.

Figure 4:
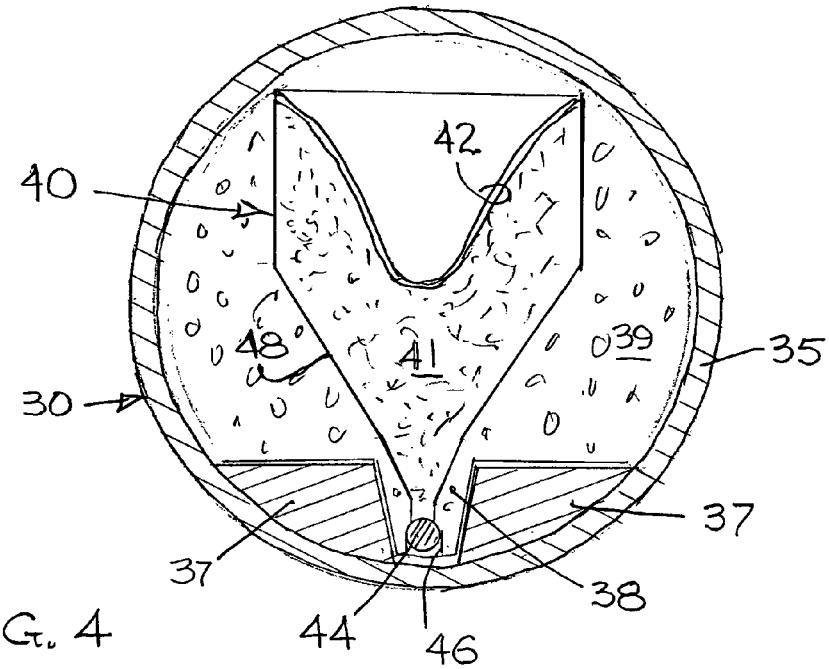
FIG. 4 is a partially sectioned, perspective view of the charge carrier assembly according to the invention.
Figure 3:
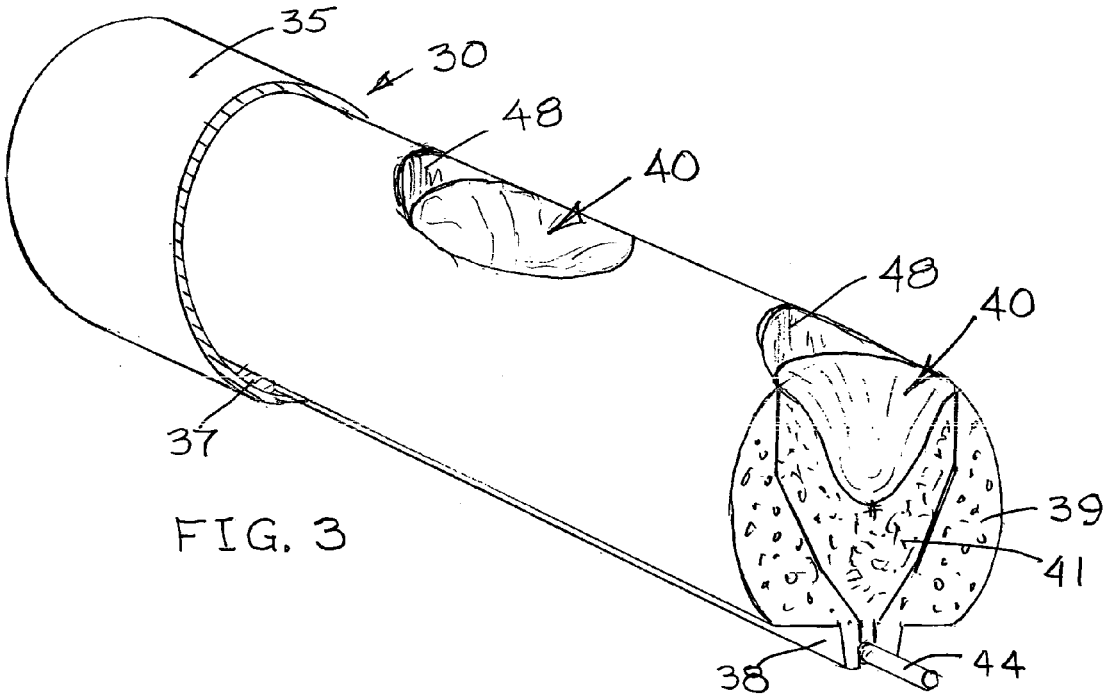
FIG. 3 is a cross-section of a charge carrier according to the invention.

The orientation technique illustrated by FIGS. 3 and 4 comprises a pair of ballast rails 37 secured to the inner wall surface of an outer gun tube 35. The ballast rails 37 are separated by a V-channel. A loading tube 39 is formed with a ridge 38 that rotatively confines alignment of the loading tube 39 between the ballast rails 37.

The loading tube 39 is a light weight element such as "solid" Styrofoam or similar large cell, expanded plastic material. Some foamed glass materials may also be suitable. At appropriately spaced locations along the loading tube 39 are sockets 48 for receiving preformed units of shaped charge 40. In the present example, the shaped charge discharge axes are aligned in a single plane.

The loading tube 39 is stepped on opposite sides of a ridge 38 to co-axially assemble within the gun tube wall 35 between the ballast rails 37. This ridge confinement necessarily orients the discharge plane of the shaped charge units 40. The mass of the eccentrically concentrated ballast rails 37 provides a gravitational bias to a vertical orientation of the outer gun tube 35. The V-channel between the ballast rails 37 keys the annular orientation of the loading tube 39 relative to the outer gun tube 35. The shaped charge 40 may given any desired angular orientation within the loading tube 39 for the discharge axis of the perforating jet 32 relative to the ridge key 38. The relative orientation illustrated by FIGS. 2, 3 and 4 represents a shaped charge discharge axis 32 that is parallel with a vertical plane. However, the angular direction of the shaped charge discharge jet 32 about the gun axis may be set at any convenient or desired angle relative to the vertical plane. Hence, the perforation axis of the jet 32 relative to a gravity vertical may be predetermined.

Along the ridge 38 crest is a channel 46 for receiving a detonation cord 44. The shaped charge explosive 41 intimately engages the detonation cord 44.

An appropriate example of the invention may begin by contrasting the present invention with the previous example of a traditional, 5 in. O.D. steel gun tube 35 having a distributed displacement volume of 0.1363 $ft^3/ft$ and a distributed weight in air of about 14.75 lb/ft. For a 62 $\#/ft^3$ well fluid applied, the distributed downhole weight of the perforating gun is 6.3 lb/ft. Steel has a specific gravity of approximately 7.83. Plastic composites have a great range of specific gravity values but for a composite of suitable strength, a material having a specific gravity of 2.5 is chosen.

Comparatively, a predominately composite charge carrier having a specific gravity of about 2.5 and approximately the same dimensions as the steel charge carrier therefore could have a distributed air weight of about 4.61 #/ft. With the same distributed volume as the steel charge carrier in the same fluid (water @ 62 $\#/ft^3$), the composite charge carrier also has a distributed buoyancy of about 8.45 #/ft. Resultantly, the distributed buoyancy of 8.45 #/ft is deducted from the composite carrier distributed air weight of 4.61 #/ft to conclude that a buoyant force of 3.84 #/ft will drive the gun against the top of the wellbore as shown by FIG. 2.

For upwardly directed perforations 32, the buoyant gun 30 has the distinct advantage of intimate proximity with the top-most elements of the casing wall 20. However, the effect of friction on the gun is the same whether applied to the bottom or the top of the gun. Accordingly, the 0.5 coefficient of friction against the wellbore roof will generate a drag load of 1.92 #/ft on the 4.61 #/ft (air weight) composite gun.

Using the 4500 lb thrust tractor, a 2,345 ft long gun may be positioned in the 6,000 ft horizontal bore of the initial example. Although this is a vast improvement over the preceding state of art, the improvement does not change the fact that the remaining 3700 ft of second shot perforation cannot receive an underbalance well state for the shot.

However, note is given to the foregoing example that the dimensions of the composite charge carrier were the same as those of the steel charge carrier. Clearly, the wall thickness of a composite material charge carrier may be increased to increase the distributed air weight and thereby ballast against the buoyancy. Such composite material constructions will trend in the direction of an approximately neutral buoyancy which, typically, will be the objective. For example, if buoyancy is adjusted to 0.5 #/ft, only 1500# of thrust force would be required to run the full 6000 ft. gun in one trip.

Neutral buoyancy in bottom-hole assemblies such as perforating guns may be obtained using steel having a comparatively reduced wall thickness and/or by using other, light-weight materials such as aluminum, alloys of magnesium or titanium and polymer matrices with high strength fibers such as carbon or glass.

Other weight reduction strategies for perforating guns may also include such steps as omitting the heavy steel cases used by the prior art to confine the shaped charge explosive. In lieu of the omitted steel case, each shaped charge unit may be a) press-formed within a molding die using no dedicated casement or b) formed within a paper, aluminum foil, composite or other such light weight encapsulation medium. These light weight charges may thereafter be seated within corresponding sockets formed into a light weight material loading tube 39 such as STYROFOAM or other foamed polymer. In the present context, "composite material" is also intended to mean a glass, carbon or polyaramid fiber matrix impregnated by an epoxy or ester polymer resin as well foamed glass and foamed polymer such as STYROFOAM.

A composite material construction of an outer gun tube 35 may include a pipe wall that is formed by a continuous circumferential winding of resin impregnated fibers. There are no "ports" in the outer gun tube 35. The interior of the outer gun tube 35 is configured to accommodate a sliding, axial insertion of the inner loading tube 39. Beyond a minimum hoop strength thickness to prevent crushing by downhole fluid pressure and perimeter swelling due to charge detonation, the thickness of the outer gun tube wall is a variable that is adaptable to buoyancy control.

Of course, it will be understood by those of ordinary skill in the art that maintaining a minimum air weight of the gun system will be desirable to minimize the forces required to pull the gun from the well after firing.

Although the invention has been described with respect to horizontal wellbores and those having a slope less than the angle of repose, it should be understood that the principles of the invention also apply to traditional vertical wells where extremely long guns and/or a complex assembly of well tools may be deployed. When the perforating gun or well tool is designed for substantially neutral buoyancy, the gun or well tool becomes a no-load appendage at the end of the support string.

Materials and dimension selections allow wide latitude to design a gun assembly having neutral or near-neutral buoyancy in the well fluid that normally floods a deep wellbore. With neutral buoyancy, placement of a horizontal gun is opposed only by the fluid friction of the well fluid. Adjusting the charge carrier elements to produce a fractional positive buoyancy will allow the gun to rise against the top of the well bore for charge ignition. Conversely, a fractional negative buoyancy to the perforating gun will bias it onto the bottom of a horizontal wellbore for a down directed perforation.

While preferred embodiments of the invention have been shown and described, modifications thereof may be made by those skilled in the art without departing from the spirit or teaching of the invention. The embodiments described herein are exemplary only and are not intended as limiting or exclusive. Many variations and modifications of the invention are possible and obvious to those of ordinary skill in the art. Accordingly, the scope of protection is not limited to the embodiments described herein, but is limited only by the following claims, the scope of which shall include all equivalents of the subject matter of the claims.

We claim:

1. A method of placing, within a wellbore containing a fluid, a bottom-hole tool assembly suspended by a support string, said method comprising the bottom-hole tool fabrication step of coordinating the distributed weight of said assembly with the distributed volume of said assembly and the specific gravity of said wellbore fluid to substantially reduce a bottom hole tool support load on said support string.

2. A method as described by claim 1 wherein said bottom-hole assembly is a perforating gun.

3. A method as described by claim 1 wherein said wellbore fluid is predominantly a liquid.

4. A method of placing a bottom-hole tool assembly within a wellbore containing a fluid wherein at least a portion of the wellbore directional course is advanced along a slope that is less than an angle of repose for said tool assembly against a wall surface of said wellbore, said method comprising the step of coordinating the distributed weight of said assembly with the distributed volume of said assembly and the specific gravity of said fluid to predetermine a bearing force of said assembly against said wellbore wall surface.

5. A method as described by claim 4 wherein the bearing force of said tool assembly is biased to buoy said assembly substantially against uppermost elements of said wall surface.

6. A method as described by claim 5 wherein said bottom-hole tool assembly is a perforating gun.

7. A method as described by claim 4 wherein the buoyancy of said tool assembly is biased to sink said assembly against substantially lowermost elements of said wall surface.

8. A method as described by claim 7 wherein said bottom-hole tool assembly is a perforating gun.

9. A method as described by claim 4 wherein said bottom-hole tool assembly is a perforating gun.

10. A method as described by claim 4 wherein said step of coordinating the distributed weight of said assembly with the distributed volume of said assembly and the specific gravity of said fluid predetermines a neutral buoyancy having substantially no bearing force of said assembly against said wellbore wall surface.

11. A well perforation apparatus comprising a shaped charge loading tube having a first distributed weight enclosed within an axially elongated outer gun tube, said outer gun tube having a second distributed weight and a distributed volume, said distributed volume and said first and second distributed weights being coordinated for a predetermined, approximately neutral, apparatus buoyancy, ballast means distributed along a length of said outer gun tube asymmetrically of a gun tube axis and a plurality of shaped explosive charges operatively secured within said loading tube for perforating a subterranean well at a predetermined orientation angle relative to vertical.

12. A well perforation apparatus as described by claim 11 wherein said outer gun tube is fabricated from a composite material comprising a fiber and polymer matrix.

13. A well perforation apparatus as described by claim 12 wherein the fiber in said matrix is glass.

14. A well perforation apparatus as described by claim 12 wherein the fiber in said matrix is carbon.

15. A well perforation apparatus as described by claim 12 wherein the fiber in said matrix is polyaramid.

16. A well perforation apparatus as described by claim 12 wherein the polymer in said matrix is an epoxy.

17. A well perforation apparatus as described by claim 12 wherein the polymer in said matrix is an ester.

18. A well perforation apparatus as described by claim 11 wherein said loading tube is fabricated with light weight material.

19. A well perforation apparatus as described by claim 18 wherein the fabrication material of said loading tube is a plastic composite.

20. A well perforation apparatus as described by claim 18 wherein the fabrication material of said loading tube is a foamed polymer.

21. A well perforation apparatus as described by claim 18 wherein the fabrication material of said loading tube is a composite material.

22. A well perforation apparatus as described by claim 18 wherein the fabrication material of said loading tube is a foamed glass.

23. A well perforation apparatus as described by claim 11 wherein said outer gun tube is fabricated from steel.

24. A well perforation apparatus as described by claim 11 wherein said outer gun tube is fabricated from aluminum.

25. A well perforation apparatus as described by claim 11 wherein said outer gun tube is fabricated from aluminum alloy.

26. A well perforation apparatus as described by claim 11 wherein said outer gun tube is fabricated from magnesium alloy.

27. A well perforation apparatus as described by claim 11 wherein said outer gun tube is fabricated from titanium alloy.

28. A well perforating gun comprising the assembly of a loading tube, a plurality of shaped charges and an outer gun tube, said loading tube having sockets to secure and angularly orient said shaped charges, an assembly of said loading tube and shaped charges within said outer gun tube providing a predetermined angular orientation of said shaped charges relative to a gravitationally biased plane of said assembly, weight and volume of said loading tube, shaped charges and gun tube being coordinated for a predetermined buoyancy of said assembly.

29. A well perforating gun loading tube as described by claim 28 fabricated with a composite material comprising a fiber and polymer matrix.

30. A well perforating gun loading tube as described by claim 29 wherein said fiber in said matrix is glass.

31. A well perforating gun loading tube as described by claim 29 wherein said fiber in said matrix is carbon.

32. A well perforating gun loading tube as described by claim 29 wherein said polymer in said matrix is an epoxy.

33. A well perforating gun loading tube as described by claim 29 wherein said polymer in said matrix is an ester.

34. A well perforating gun loading tube as described by claim 29 wherein said composite material is a foamed polymer.

35. A well perforating gun loading tube as described by claim 29 wherein said composite material is a foamed glass.

36. A light weight well perforation apparatus comprising the assembly of a light weight shaped charge loading tube enclosed within a composite material outer gun tube and a plurality of light weight shaped explosive charges operatively secured within said loading tube, longitudinally distributed weight and volume respective to said loading tube, shaped charges and outer gun tube being coordinated for a predetermined apparatus buoyancy for perforating a subterranean well bore having an inclination of about an angle of repose or less.

* * * * *